United States Patent [19]

Pasqualini et al.

[11] Patent Number: 4,617,759

[45] Date of Patent: Oct. 21, 1986

[54] PROFILE OF PLASTIC MATERIAL FOR REFRIGERATOR CABINETS

[75] Inventors: Bruno Pasqualini, Varese; Adriano Merla, Angera, both of Italy

[73] Assignee: Pantasote Inc., Greenwich, Conn.

[21] Appl. No.: 682,099

[22] Filed: Dec. 17, 1984

[30] Foreign Application Priority Data

Dec. 23, 1983 [IT] Italy ..... 24029/83[U]
Dec. 23, 1983 [IT] Italy ..... 24030/83[U]

[51] Int. Cl.[4] ..... E06B 7/16

[52] U.S. Cl. ..... 49/487; 49/489; 312/214

[58] Field of Search ..... 49/487, 482, 489, 486, 49/478; 312/214

[56] References Cited

U.S. PATENT DOCUMENTS

| | | | |
|---|---|---|---|
| 2,659,940 | 11/1953 | Beck . | |
| 2,665,456 | 1/1954 | Morton . | |
| 2,867,862 | 1/1959 | Squire . | |
| 3,126,590 | 3/1964 | Monti . | |
| 3,137,900 | 6/1964 | Carbary . | |
| 3,159,885 | 12/1964 | Cowles . | |
| 3,226,367 | 12/1965 | Monti . | |
| 3,242,537 | 3/1966 | Monti . | |
| 3,289,352 | 12/1966 | Heilweil et al. . | |
| 3,323,256 | 6/1967 | Reahard et al. . | |
| 3,353,321 | 11/1967 | Heilweil et al. . | |
| 3,378,957 | 4/1968 | Frehse . | |
| 3,448,543 | 6/1969 | Multer . | |
| 3,763,595 | 10/1973 | Sudyk | 49/489 |
| 3,869,873 | 3/1975 | Thomas . | |
| 4,034,511 | 7/1977 | Bursk . | |
| 4,134,627 | 1/1979 | Kuskowski . | |
| 4,305,230 | 12/1981 | Gerritsen . | |

FOREIGN PATENT DOCUMENTS

| | | |
|---|---|---|
| 6909012 | 3/1969 | Fed. Rep. of Germany . |
| 6911963 | 4/1969 | Fed. Rep. of Germany . |
| 6929909 | 7/1969 | Fed. Rep. of Germany . |
| 6940482 | 10/1970 | Fed. Rep. of Germany . |
| 1111926 | 3/1956 | France . |
| 1103748 | 2/1968 | United Kingdom . |
| 1128627 | 9/1968 | United Kingdom . |

*Primary Examiner*—Victor N. Sakran
*Attorney, Agent, or Firm*—Jacobs & Jacobs

[57] ABSTRACT

The invention relates to a profile of plastic material for refrigerator and similar cabinets, comprising a bellows gasket portion which provides a tight seal between the door and the cabinet, characterized in that the profile and the gasket portion are integral and form only one piece produced by co-extrusion of two materials having a different rigidity such as to permit a ready detachment of the gasket portion, which is less rigid than the profile, from the profile along the region of their connection, under an appropriate manual or mechanical force, and that the said profile has on its side facing the cabinet a pair of lateral faces between which a groove is defined, suitable for receiving a substituting bellows gasket portion, and on its side facing the door at least one side-flange elastically yielding, acting as a spring for press (snap) coupling the door and the counterdoor in cooperation with the said lateral faces, each one of the said faces operatively self-positioning relatively to the door shell and the counterdoor.

10 Claims, 5 Drawing Figures

PROFILE OF PLASTIC MATERIAL FOR REFRIGERATOR CABINETS

In the field of the production of refrigerator cabinets, freezers, and other containers for the cold storing it is known to provide the necessary seal between the cabinet body of the refrigerator on one side, and the door assembly on the other side, by means of a sealing gasket of flexible material, usually rubber or PVC, that extends along the whole perimeter of the door.

Such gasket is usually a bellows gasket, having a tubular cross section, with usually a portion of tubular cross section into which is placed a magnetic member such as the known plastic magnets.

This gasket is assembled by the manufacturer of the refrigerator, when assembling the door, between the shell of steel sheet and the counterdoor or pan of plastic material, usually by clamping it between the edge of the shell and the edge of the counterdoor when such edges, after having been superimposed, are fastened to each other, such as for instance by screw fasteners.

This procedure as described consists therefore of two stages which are to be provided for by the manufacturer, which result in considerable manpower costs.

Furthermore, the fastening operations, and similar operations, must be carried out on the whole perimeter of the door, and are neither quickly nor easily carried out.

Sealing profiles more recently proposed in the art are for example those disclosed in the U.S. Pat. Nos. 4,305,230 and 4,034,511.

The present invention sets out to attain a series of objects as compared to these known profiles.

One object of the invention is to make it possible for end-users themselves to effect a ready and rapid substitution of the gasket, when this has become worn, with a new gasket without such substitution calling for the demounting of the profile from the refrigerator door.

Another object of the present invention is to substantially simplify the assembling process of the gasket, and more particularly to allow the assembling of the door, counterdoor or pan and gasket to be carried out as an automatic process, or by means of robots. Another object of the present invention is to guarantee an economic advantage to the manufacturer of the gasket, which to this purpose should therefore consist of one piece only, avoiding the need of fastening a plurality of pieces in the assembling stage.

A further object of the present invention is related to the fact that the hollow space defined by the steel sheet door shell and the plastic counterdoor or pan, when assembled to each other, is filled, as it is known in the art, with a thermal insulating material, usually by means of a suitable foamed plastic material; during the foaming stage, the plastic foam material tends to escape from the inside to the outside in the region of the mutual engagement of the door shell, the counterdoor and the gasket, owing to the dimensional tolerances between these components; the leakage of the plastic material during the filling stage leads to complex cleaning and finishing operations of the door, which result in further costs to be sustained by the manufacturer, one object of the present invention being avoiding such costs.

To the purpose of realizing the objects as above set forth, the present invention proposes a profile of plastic material for refrigerator and similar cabinets, equipped with a bellows gasket portion that provides a tight seal between the door and the cabinet, characterized in that such profile and such gasket portion are integral and form one piece only, produced by co-extrusion of two materials having a different rigidity such as to permit a ready detachment of the gasket portion, which is less rigid than the profile, from the profile along the region of their connection, under an appropriate manual or mechanical force; and that such profile has on its side facing the cabinet a pair of lateral faces between which a groove is defined for receiving a replacing bellows gasket portion, and on its side facing the door, at least one elastically yielding side-flange having a spring action such as to press fasten together the door shell and the counterdoor in cooperation with the said lateral faces, each one of such faces operatively self-positioning relatively to the door shell and to the counterdoor respectively.

The profile is preferably formed of rigid PVC, and the gasket of soft plasticized PVC.

To the purpose of better illustrating the advantages and the characteristics of the present invention, an embodiment of it is hereunder disclosed, as a non limitative example, with reference to the attached drawings, where:

Figure 5:
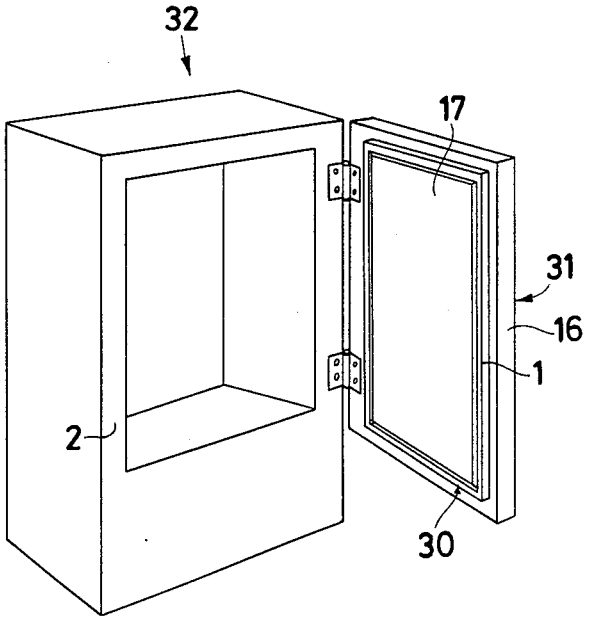
FIG. 5 is view in perspective of a refrigerator having a door made by the invention.

Referring to the drawings, a profile 1 according to the present invention has a complexly shaped section which is equipped, on its side intended for engaging a refrigerator cabinet, such as e.g. a jamb 2 of a refrigerator 32 (FIG. 5) with a pair of substantially flat lateral ribs or faces 3 and 4, comprising at their lateral edges a pair of extensions 5 and 6 respectively, such extensions lying on the sides of the faces, opposite to the sides facing the jamb. Between the two faces 3 and 4 a groove 7 is defined, having a U-shaped section and comprising on its upper part a pair of side-flanges 8. Below the groove 7 a pair of elastically yielding side-flanges 9 and 19 are provided respectively ending on their upper part with a step 10 (L-shaped section) and with a groove 20 (C-shaped section). The profile 1 may omit flange 9 and have only the flange 19, intended for engaging the counterdoor or shell 17.

Profile 1 is made of rigid plastic material, such as PVC, and has an integral gasket portion 18 of flexible plastic or elastomeric material, such as plasticized PVC. Profile 1 and its integral gasket portion 18 are formed by co-extrusion and cut into segments of desired length. If desired, the segments can be used as such to provide seals for entryway doors, dishwashers and the like. The segments may also be heat welded together to form a frame 30 (FIG. 5) that is secured to the door 31 of a refrigerator 32 as discussed below. According to the invention, when the cut segments are heat welded together to form the frame 30, the gasket portion 18 is heated to a lower temperature than profile 1 to avoid overheating.

Suitably, a two-zone heating system will be used.

The gasket portion 18 has a tubular cross section comprising a pair of chambers 13 and 14 acting as a bellows, and a third chamber 15 for receiving an element of magnetic material, such as, for example, a ferrite in a plastic binder.

To assemble the refrigerator door 31, the profile 1 with the gasket portion 18 is conveniently previously given the shape of a frame 30, and supplied in this shape to the manufacturer of the refrigerator cabinet. The manufacturer can assemble by means of a single stage operation the steel sheet door shell 16 to the plastic counterdoor 17 by press (snap) inserting the profile 1 between them, which couples the door shell 16 and the counterdoor 17 together, owing to the action of the side-flanges 9, 19 which behave as springs. In the coupling condition, the seal between the profile 1 and the counterdoor 17 is secured by the mutual engagement of the groove 20 of the side-flange 19 and the end of the edge of the counterdoor 17.

Figure 1:
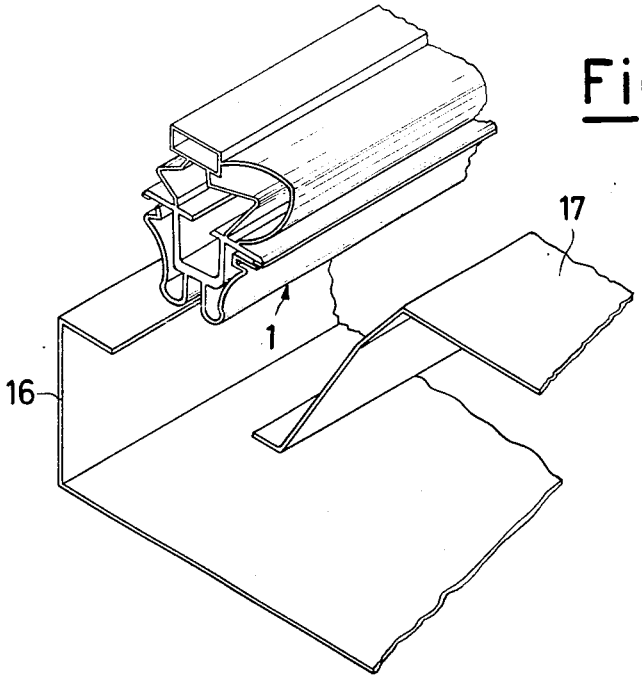
FIG. 1 shows a perspective view of a profile according to the present invention, combined with the other components with which it is intended for cooperation, prior to assembly.
Figure 2:
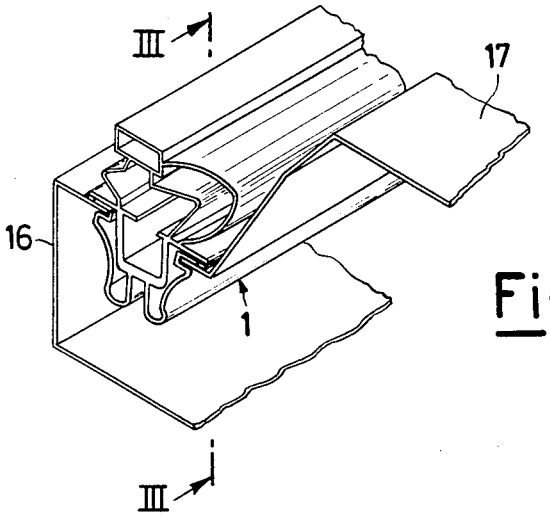
FIG. 2 is a view similar to FIG. 1, after assembly.
Figure 3:
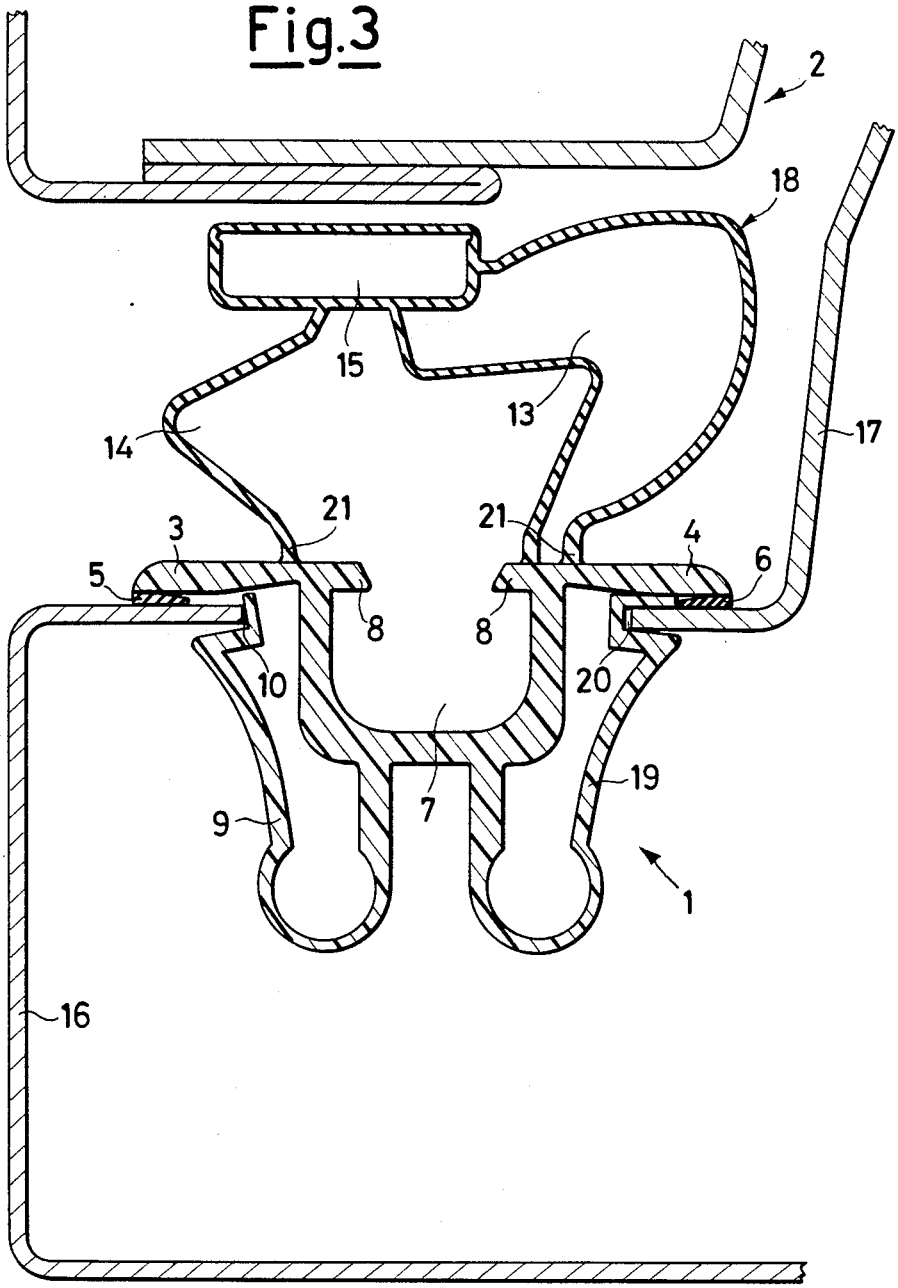
FIG. 3 is a view in section taken along the line III—III of FIG. 2.
Figure 4:
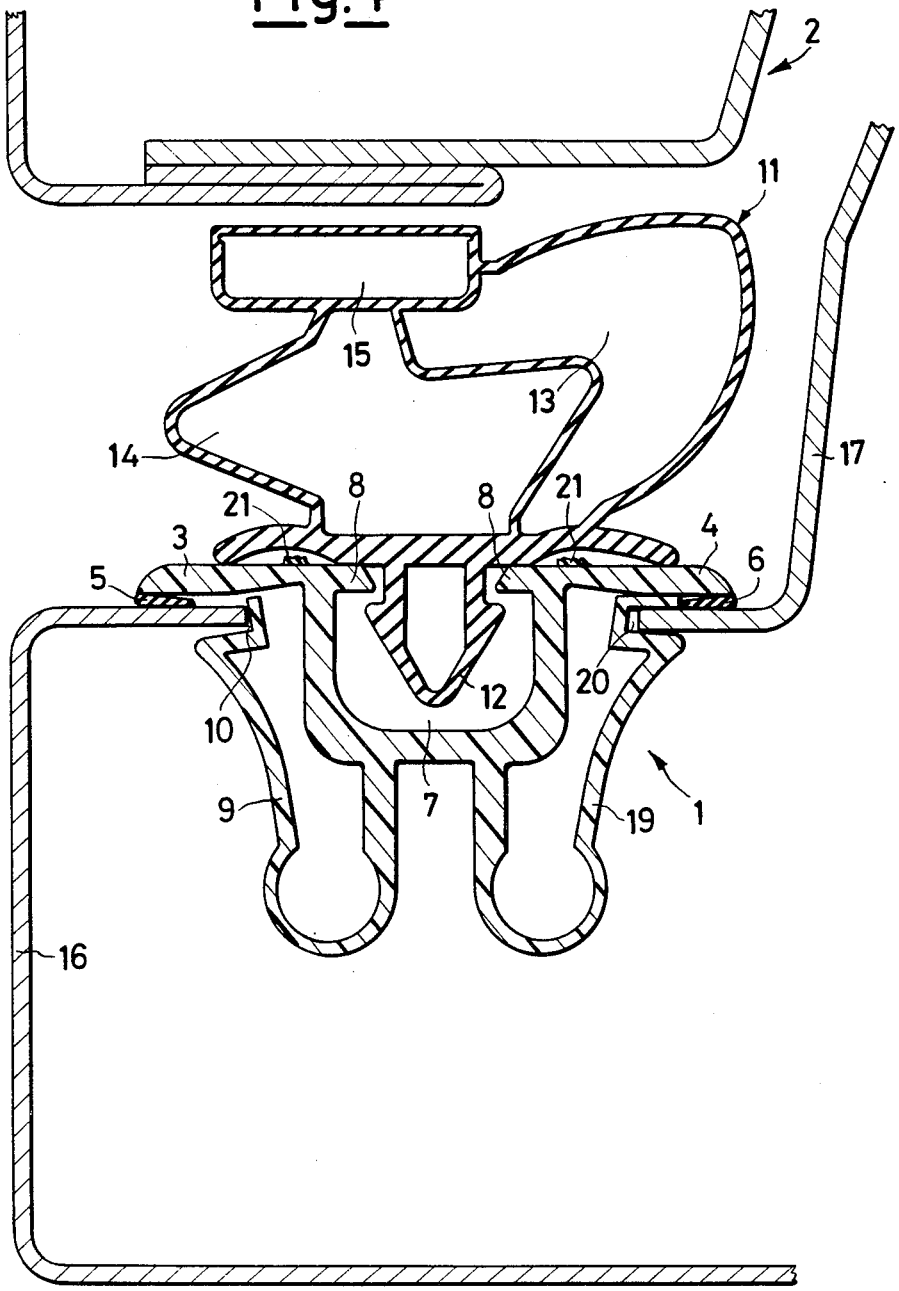
FIG. 4 is a view in section similar to FIG. 3, in which the original gasket portion has been replaced by a second gasekt.

As it is shown in FIG. 4, when the flexible co-extruded gasket portion 18 has to be replaced, such as due to wear, it is possible to effect a quick substitution by removing under an appropriate manual or mechanical force the original gasket portion 18, as by cutting along the region 21 of its connection to the profile 1 and inserting inside the groove 7 a new gasket 11, having a point-shaped coupling element 12.

This is an evident advantage of the present invention, as the substitution of the replacement gasket does not involve the substitution of other components, such as the profile 1, and proves to be a quick and easy operation.

An advantage of the herein disclosed invention is also the circumstance that a frame-gasket system can be predisposed in the form of a single piece component; this results in an avident notable economic saving for the manufacturer of the item, who is able to obtain, by means of a single stage moulding operation, the profile and the gasket without needing to assemble them subsequently. For the manufacturer of the refrigerator there is then the advantage that it becomes possible for him to assemble the door, counterdoor and gasket by an automatic process, or by means of robots.

We claim:

1. In a profile of plastic material for coupling the door shell and counterdoor of refrigerator and similar cabinets, comprising a bellows gasket portion which provides a tight seal between the door and the cabinet, the improvement wherein the profile and the gasket portion are integral and form only one piece produced by co-extrusion of two materials having a different rigidity such as to permit a ready detachment of the gasket portion, which is less rigid than the profile, from the profile along the region of their connection, under an appropriate manual or mechanical force, and wherein said profile has on its side facing the cabinet a pair of lateral ribs between which a groove is defined, suitable for receiving a substituting bellows gasket portion, and on its side facing the door at least one elastically yielding flange means, acting as a spring, for press (snap) coupling the door shell and the counterdoor in cooperation with said lateral ribs, said ribs operatively self-positioning relatively to the door shell and the counterdoor.

2. Profile as claimed in claim 1, wherein each of said lateral ribs has on its end an extension sealing element turned towards the side of the profile facing the door.

3. Profile as claimed in claim 1, wherein one said flange means has on its upper end a groove with a C-shaped section, suitable for engaging the edge of the counterdoor.

4. A frame comprising segments of the profile according to claim 1 heat welded together.

5. Door of a refrigerator and similar cabinet, having a frame according to claim 4 secured thereto.

6. In a profile of plastic material for coupling the door shell and counterdoor refrigerator and similar cabinets, comprising a bellows gasket portion which provides a tight seal between the door and the cabinet, the improvement wherein the profile and the gasket portion are integral and form only one piece produced by co-extrusion of two materials having a different rigidity such as to permit a ready detachment of the gasket portion, which is less rigid than the profile along the region of their connection, under an appropriate manual or mechanical force, and wherein said profile has on its side facing the cabinet a pair of lateral ribs between which a groove is defined, suitable for receiving a substituting bellows gasket portion, and on its side facing the door a pair of elastically yielding flange means, acting as springs, for press (snap) coupling the door shell and the counterdoor in cooperation with said lateral ribs, said ribs operatively self-positioning relatively to the door shell and the counterdoor.

7. Profile as claimed in claim 6, wherein each of said lateral ribs has on its end an extension sealing element turned towards the side of the profile facing the door.

8. Profile as claimed in claim 6, wherein one said flange means has on its upper end a groove with a C-shaped section, suitable for engaging the edge of the counterdoor.

9. A frame comprising segments of the profile according to claim 6 heat welded together.

10. Door of a refrigerator and similar cabinet, having a frame according to claim 9 secured thereto.

* * * * *